United States Patent [19]

Hirabayashi et al.

[11] 4,267,031

[45] May 12, 1981

[54] COKING PROCESS

[75] Inventors: Hideo Hirabayashi, Yokohama; Hiroshi Yamaguchi, Tokyo; Masahiko Uemura, Ohi, all of Japan

[73] Assignee: Toa Nenryo Kogyo Kabushiki Kaisha, Tokyo, Japan

[21] Appl. No.: 745,223

[22] Filed: Nov. 26, 1976

[30] Foreign Application Priority Data

Dec. 10, 1975 [JP] Japan ..... 50-147672

[51] Int. Cl.[3] ..... C10G 9/14

[52] U.S. Cl. ..... 208/106; 208/131

[58] Field of Search ..... 208/48 R, 131, 132, 208/106, 129

[56] References Cited

U.S. PATENT DOCUMENTS

| | | | |
|---|---|---|---|
| 1,989,445 | 1/1935 | Clark | 208/129 |
| 2,014,212 | 9/1935 | Seguy | 208/129 |
| 2,086,741 | 7/1937 | Sachs | 208/131 |
| 2,312,719 | 3/1943 | Kuhl | 208/131 |
| 3,580,959 | 5/1971 | Dorner | 208/132 |

*Primary Examiner*—Herbert Levine

*Attorney, Agent, or Firm*—Reuben Miller

[57] ABSTRACT

A hydrocarbon oil coking process in which the feedstock is initially preheated to a temperature below the cracking temperature of the feedstock, prior to contacting the feedstock with a flue gas obtained from the coking zone so as to preheat the feedstock to the desired coking temperature and thereafter coking the preheated feedstock at a temperature above the cracking temperature of the feedstock.

9 Claims, 1 Drawing Figure

COKING PROCESS

Figure 1:
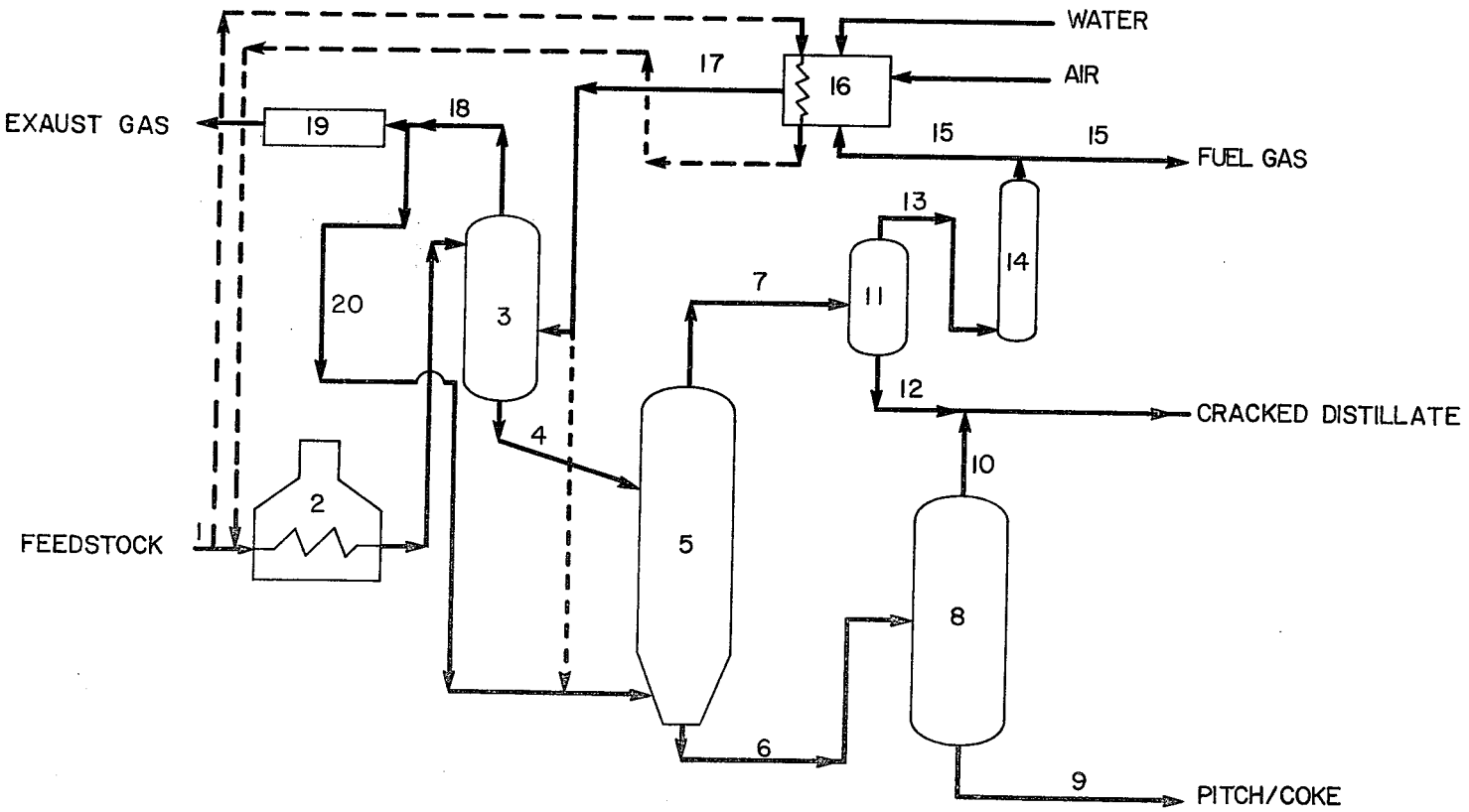

This invention relates to a process for the coking of hydrocarbon oils, and more particularly to a process for the coking of heavy hydrocarbons by using a combustion exhaust gas as a heating medium.

One industrialized thermal conversion process of heavy hydrocarbon oils is known as a "delayed coking process". According to the delayed coking process, heating of the hydrocarbon oil to a temperature required for coking is performed entirely in a heating furnace and as a result of this procedure the coking product in the heating furnace tube tends to deposit on the tube wall, which results in reduced operating efficiency of the apparatus. In order to prevent such deposition of the coking product in the heating furnace tube, procedures such as injecting steam into the tube, rearranging burners in the furnace or controlling the flow rate in the tube have been suggested. However, none of these methods is wholly satisfactory for preventing deposition of the coking product in the heating furnace tube.

Now, according to the present invention, it has been discovered that such problems can be solved by a novel process for coking heavy hydrocarbon oil feedstocks which comprises heating the feedstock in a preheating zone and then introducing the preheated feedstock into a coking zone to perform coking therein, the process being characterized by the steps of first preheating the feedstock in a preheating zone to a temperature not high enough to intitiate cracking of said feedstock, then contacting this preheated feedstock in a combustion exhaust gas contact zone with combustion gas produced from said coking zone, said gas being maintained at a temperature capable of elevating the preheated feedstock temperature by heat exchange to a temperature required for the coking step, and then bringing this heated feedstock into a coking zone maintained at a temperature higher than the cracking temperature of said feedstock.

A salient feature of the process of this invention resides in that when heating the feedstock to the coking temperature, the feedstock which has been preheated to a temperature lower than the cracking temperature in a preheating zone is directly contacted with combustion exhaust gas in a combustion exhaust gas contact zone to supply heat necessary for the coking step through heat exchange. This allows lowering of the heating temperature in the preheating zone to prevent coking of the feedstock oil in this zone.

In one embodiment of this invention, discharge gas which has been contacted with the preheated feedstock in the combustion exhaust gas contact zone is introduced, if so desired, into the coking zone to serve as agitation gas. Thus, discharge gas can be circulated for reuse.

In another embodiment of this invention, combustion exhaust gas to be contacted with the preheated feedstock is controlled in temperature by water sprinkling or other suitable means.

Thus, the present invention provides a novel process scheme comprising a preheating zone and a combustion exhaust gas contact zone which are set preceding the coking zone.

The combustion exhaust gas contact zone used in the present invention is designed to supply heat required for the coking by contacting the preheated feedstock with high temperature combustion exhaust gas. It is possible to employ any type of contacting device if it is capable of attaining the desired effect. Usually, a heat exchanging tray can well serve for the purpose. The heat exchanging tray suited for use in the present invention is a baffle type tray with approximately 30 to 40 stages, the type of which is usually used where the material has a strong coking disposition. Other types of tray, such as a sieve tray, are unsuited for the method of this invention because such sieve tray involves the possibility that the sieve may become clogged by the produced coke. Contact is effected by introducing the feedstock into the upper part of the contacting device while introducing combustion exhaust gas into the lower part of the device so that they counterflow each other in the contacting device, thereby effecting heat exchange between them.

The combustion exhaust gas introduced into the combustion exhaust gas contact zone is a high temperature gas which is produced by the coking process in the coking zone. If need be, the gas is previously subjected to refining such as desulfurization and may be mixed, if necessary, with other fuel gases, and is burned for supplying heat required for the preheating of the feedstock in the preheating zone and in the combustion exhaust gas contact zone and for the coking. This combustion exhaust gas is also controlled in temperature by suitable means, for instance, by water sprinkling or by heat exchange in the preheating of the feedstock. The temperature range within which the combustion exhaust gas is to be controlled is suitably determined according to the kind of feedstock used, preheating temperature and conditions of coking. In case a heavy hydrocarbon oil having a boiling point of higher than about 500° C., such as, for example, a vacuum distillation residual oil, is used as feedstock, the temperature of the combustion exhaust gas ranges from about 500° to about 1,000° C., preferably from about 700° to about 800° C.

Generally, the combustion exhaust gas comprises water vapor, carbon dioxide gas and nitrogen, but it may contain a limited amount of light hydrocarbons generated from decomposition of hydrocarbon oil. Normally, combustion exhaust gases having the following compositions can be used in the method of this invention.

Water vapor: about 40 to about 60 volume %
Carbon dioxide gas: about 5 to about 10 volume %
Nitrogen: about 40 to about 50 volume %

The treating conditions in the combustion exhaust gas contact zone may be suitably adopted depending on the kind of feedstock, conditions of the coking zone and other factors. In the case of using said heavy hydrocarbon oil as a feedstock, the following conditions may be generally employed:

Average liquid temperature: about 400° to about 500° C.
Average gas temperature: about 500° to about 650° C.
Average pressure: less than about 5 $kg/cm^2G$
Gas/liquid ratio (volume ratio under the above-said conditions): about 100 to about 160
Residence time: about 0.1 to about 1 mins.

The effluent from this combustion exhaust gas contact zone is already heated to a temperature required for the succeeding coking step, so that it is immediately led into the coking zone.

The coking zone may be constructed by using a known coking drum. The coking step is carried out under the following coking reaction conditions:

Temperature: about 380° to about 550° C.
Pressure: normal pressure to about 50 kg/cm$^2$G
Residence time: about 0.5 to about 20 hours Through the conversion of hydrocarbons, there are obtained gaseous and liquid products and coke. Depending on the choice of the coking reaction conditions, the conversion rate may be changed to obtain the respective products at desired yields and with desired properties.

The above-described coking reaction conditions embrace the conventional delayed coking conditions, and such treating conditions can be suitably changed as needed, so that this invention provides an improvement of the conventional delayed coking process.

As aforementioned, in one embodiment of this invention a part of the combustion exhaust gas from the combustion exhaust gas contact zone may be circulated, if so desired, into the coking zone to let it serve as agitation gas. It is possible to prevent local deposition of the coking product by introducing said exhaust gas into the lower portion of the coking zone and agitating the material existing therein. For controlling the temperature in this coking zone, high temperature combustion gas may be suitably mixed with exhaust gas from said combustion exhaust gas contact zone, or such exhaust gas may be introduced singly into the coking zone for the described purpose of use.

As the preliminary preheating zone used in the process of this invention, there may be employed a normal heating furnace such as a box type, cell type, vertical cylindrical type, etc., but most preferred is a vertical cylindrical type heating furnace.

The treating conditions in the preheating zone include the heating at a temperature lower than the cracking temperature of the hydrocarbon oil feedstock with a residence time of approximately 1 to 3 minutes. The "cracking temperature" in the process of this invention is the lowest temperature necessary for conversion of hydrocarbons, and such temperature varies depending on the kind and composition of the feedstock used and/or other factors. As the heating temperature is lower than the cracking temperature in the process of this invention, there may be adopted any level of temperature which will not give rise to the coking of the feedstock. The preferred heating temperature in this step is about 15° to 40° C. lower than the cracking temperature. In the case of using a heavy hydrocarbon oil as starting material, the preferred heating temperature is within the range of about 340° to 400° C. The required amount of heat to be supplied in the coking zone can be adjusted in the combustion exhaust gas contact zone.

The stock oil used in practicing the process of this invention may be of any type if it is capable of producing the described effect of the invention. For example, there may be employed a coal-system heavy hydrocarbon oil or a petroleum-system heavy hydrocarbon oil. The preferred example of the petroleum-system heavy hydrocarbon oil is one which contains asphaltenes or generally, a topping residual oil or a vacuum distillation residual oil containing the fraction boiling about 480° C. in an amount of approximately 30 to 100 volume %. It is also possible to use a mixture of asphalt and vacuum distillation residual oil.

Feedstock that can be treated effectively by the method of this invention is one generally having the following properties:

Specific gravity: about 0.95 to about 1.10
Sulfur content: about 1 to about 10 wt. %
Metal content (nickel+vanadium): more than about 100 ppm
Asphaltenes: more than about 5 wt. %
Conradson Carbon residue: more than about 7 wt. %

The process of this invention may now be described with reference to the accompanying drawing. FIG. 1 is a flow sheet describing a preferred embodiment of the process of this invention.

Referring to FIG. 1, heavy oil (feedstock) is fed via line 1 preheat into a furnace 2, either immediately or after being partially preheated by a combustion gas generator 16, and heated therein to a temperature lower than the cracking temperature of the feedstock, and then is guided into a combustion gas contact tower 3 to which heat is supplied via line 17 by a combustion gas generated in generator 16 to a temperature required for the predetermined coking step. The heated oil discharged out from the bottom of said combustion gas contact tower 3 is further led by line 4 into a coking reactor 5 and partly coked therein. On the other hand, the gas released from the top of said contact tower 3 is partly sent into said reactor 5 via lines 18 and 20 and used as agitation gas while the remainder of the gas is perfectly burned in an unburned gas combustor 19. The portion of the gas in line 20 used as agitation gas may be mixed via line 17 with a part of high temperature combustion gas from generator 16 for controlling the temperature of the coking reactor 5. The cracked heavy oil containing crude coke produced in said reactor 5 is supplied via line 6 into a vacuum distillation tower 8 where the material is fractionated into a tower bottom oil fraction containing the entire amount of the produced crude coke (pitch+coke) and withdrawn through line 9 and a tower top oil fraction which may, if desired, be blended via line 10 with the light oil in line 12. On the other hand, a cracked distillate fraction is led via line 7 into a gas separator 11 and separated therein into a cracked light oil fraction removed via line 12 and gas fraction removed via line 13. The cracked light oil in line 12 and the vacuum distillation tower top oil in line 10 are mixed and used, for example, as the material for the desulfurization apparatus. The distillation gas in line 13 is desulfurized in an absorption tower 14 and turned into a combustion gas having a medium degree of heat release value, of which a portion is forwarded via line 15 into combustion gas generator 16 where a combustion exhaust gas controlled in temperature by water sprinkling is produced.

As described above, this invention provides a method of coking heavy hydrocarbon oil by subjecting the feedstock to a temperature higher than the cracking temperature of the feedstock, characterized in that the feedstock is preheated to a temperature lower than the cracking temperature and thereafter directly contacted with a temperature-controlled combustion exhaust gas and thereby heated to a temperature required for the coking step. Consequently, this invention gives the following prominent effects.

(1) Since the preheat zone outlet temperature can be controlled to stay lower than the cracking temperature of the feedstock, the problem of coking in such preheat zone is eliminated and the operating efficiency of the apparatus is improved.

(2) Since the temperature of the combustion discharge gas used for heating the feedstock to a temperature required for coking is substantially equal to the temperature in the coking zone, such combustion exhaust gas may be used immediately as agitation gas and also the problem of deposition of the coking product on the reactor wall in said zone is solved.

EXAMPLE

Combustion exhaust gas (consisting of water, carbon dioxide gas and nitrogen mixed in the volume ratio of 50:7:43) controlled in the temperature of 800° C. by water sprinkling and Guch Saran vacuum distillation residual oil preheated to 370° C. were introduced into a combustion exhaust gas contact tower equipped with a 35-stage baffle tray and heat-exchanged therein by adjusting the gas to liquid ratio (by volume) to 160 to 1. Consequently, the temperature of the tower top gas dropped to 480° C. while the temperature of the feedstock elevated to 432° C. The overall heat transfer coefficient of the baffle tray at this time was 300 Kcal/m$^2$ hr. °C. On the other hand, the tower top gas contained a small amount of hydrocarbons produced by thermal cracking of the feedstock. The amount of such hydrocarbons, as calculated on the basis of weight of the stock oil, was 0.7% by weight, and the average molecular weight was 83.2 The feedstock which was heated to 432° C. was subjected to coking for 1.5 hours, obtaining the results shown below.

| | % (by weight) |
|---|---|
| Fuel gas | 2.6 |
| Naphtha | 12.8 |
| Gas oil | 59.6 |
| Pitch + coke | 25.0 |
| | 100.0 |

Comparison was made by way of residence time, concerning the degree of the coking problem in the feedstock preheating stage which gives the temperature required for the coking. It is found that, in the ordinary coking process, the residence time in the feedstock preheating furnace, from the cracking temperature to the temperature required for the coking is reached, is 1 to 3 minutes whereas the residence time in the exhaust gas contact tower in the process of this invention is 0.1 to 1 minute. This means that the process according to this invention can restrain the coking problem down to 1/10 that of the ordinary coking process.

It will be apparent that, according to the process of this invention, it is possible to prevent the coking product from depositing in the heating furnace tubes, and also to provide the heat for preheating the feedstock to a temperature required for the coking step by the means of contacting the feedstock with a combustion exhaust gas.

Many modifications and alterations of this invention will be apparent to those skilled in the art without departing from the spirit and scope of the present invention which is limited only by the claims.

What is claimed is:

1. A process for coking hydrocarbon oils which comprises the following steps in combination:

(a) preheating a hydrocarbon oil feedstock in a preheating zone to a temperature lower than the cracking temperature of said feedstock;

(b) directly contacting the preheated feedstock from step (a) in a combustion exhaust gas zone with combustion exhaust gas produced in the combustion gas generation zone of step (e), said gas being maintained at a temperature capable of heating the said feedstock to a temperature higher than its cracking temperature;

(c) thereafter introducing said heated feedstock into a coking zone maintained at a temperature higher than the cracking temperature of said feedstock so as to coke at least a portion of said feedstock;

(d) separating hot gaseous, liquid and solid products from said coking zones;

(e) introducing at least a portion of said hot gaseous product to a combustion gas generation zone; and (f) introducing at least a portion of the combustion exhaust gas produced in said combustion gas generation zone to said combustion exhaust gas contact zone of step (b).

2. A process according to claim 1 wherein said combustion gas in step (b) is maintained at a temperature in the range from about 500° to about 1000° C.

3. A process according to claim 1 wherein said combustion gas in step (b) is maintained at a temperature in the range from about 700° to about 800° C.

4. A process according to claim 1 wherein said coking zone in step (c) is maintained at a temperature in the range from about 380° to about 550° C., a pressure in the range from atmospheric to about 50 kg/cm$^2$G and for a residence time in the range from about 0.5 to about 20 hours.

5. A process according to claim 1 wherein said combustion exhaust gas contact zone of step (b) is maintained at an average liquid temperature in the range of 400° to 500° C., an average gas temperature in the range from about 500° to about 650° C., an average pressure of less than about 5 kg/cm$^2$G, a gas to liquid volume ratio in the range from about 100 to about 160 and for a residence time in the range from about 0.1 to about 1 minute.

6. A process according to claim 1 wherein the hydrocarbon oil feedstock in said preheating zone of step (a) is heated to a temperature of about 15° to 40° C. lower than the cracking temperature of said feedstock.

7. A process according to claim 1 wherein the hydrocarbon oil feedstock has a specific gravity of between about 0.95 to about 1.10, a sulfur content in the range of about 1 to about 10 wt. %, a metal content of more than about 100 ppm, an asphaltene content of more than about 5 wt. %, and a Conradson Carbon residue of more than about 7 wt. %.

8. A process for coking hydrocarbon oil which comprises the following steps in combination:

(a) preheating a hydrocarbon oil feedstock having a Conradson Carbon residue of more than about 7 wt. % and a specific gravity in the range from about 0.95 to about 1.10 in a preheating zone to a temperature in the range from about 340°–400° C.;

(b) directly contacting the preheated feedstock from step (a) in a combustion exhaust gas contact zone with combustion exhaust gas produced in the combustion gas generation zone of step (e), said gas being maintained at a temperature in the range from about 500° to about 1000° C. for a residence time in the range from about 0.1 to about 1 minute;

(c) thereafter, introducing said heated feedstock into a coking zone maintained at a temperature in the range from about 380° to about 550° C., a pressure in the range from atmospheric to about 50 kg/cm$^2$G and for a residence time in the range from about 0.5 to about 20 hours.

(d) separating hot gaseous, liquid and solid products from said coking zone;

(e) introducing at least a portion of said hot gaseous products to a combustion gas generation zone; and (f) introducing at least a portion of the combustion exhaust gas produced in said combustion gas generation zone to said combustion exhaust gas contact zone of step (b).

9. A process according to claim 8 wherein at least a portion of the hot gaseous product from the coking zone of step (c) is recycled back to the coking zone as an agitation gas.

* * * * *